US009196214B2

(12) United States Patent
Nakanishi

(10) Patent No.: US 9,196,214 B2
(45) Date of Patent: Nov. 24, 2015

(54) DISPLAY DEVICE

(75) Inventor: Motohiro Nakanishi, Kobe (JP)

(73) Assignee: Konica Minolta Holdings, Inc., Tokyo (JP)

( * ) Notice: Subject to any disclaimer, the term of this patent is extended or adjusted under 35 U.S.C. 154(b) by 702 days.

(21) Appl. No.: 12/866,984

(22) PCT Filed: Jan. 23, 2009

(86) PCT No.: PCT/JP2009/051071

§ 371 (c)(1),
(2), (4) Date: Aug. 10, 2010

(87) PCT Pub. No.: WO2009/101851

PCT Pub. Date: Aug. 20, 2009

(65) Prior Publication Data

US 2010/0328298 A1 Dec. 30, 2010

(30) Foreign Application Priority Data

Feb. 13, 2008 (JP) ..... 2008-031533

(51) Int. Cl.
*G09G 3/38* (2006.01)

(52) U.S. Cl.
CPC ..... *G09G 3/38* (2013.01); *G09G 2300/0439* (2013.01); *G09G 2310/04* (2013.01); *G09G 2320/0252* (2013.01); *G09G 2340/16* (2013.01); *G09G 2360/16* (2013.01)

(58) Field of Classification Search
CPC ..... G09G 3/38; G09G 3/344; G09G 2310/04; G09G 2320/10; G09G 2320/103; G09G 2340/16; G09G 2360/12; G09G 2380/14
USPC ..... 345/212, 104, 690–699, 173–179, 345/55–57, 87–89, 76, 77, 204, 107
See application file for complete search history.

(56) References Cited

U.S. PATENT DOCUMENTS 4,240,716 A 12/1980 Camlibel et al. ..... 350/363
7,492,339 B2 * 2/2009 Amundson ..... 345/87

(Continued)

FOREIGN PATENT DOCUMENTS

EP 1450567 A1 8/2004
JP 2001-306059 11/2001

(Continued)

OTHER PUBLICATIONS

Extended European Search Report (dated Sep. 6, 2012) from the European Patent Office for corresponding European Patent Application No. 09 70 9484, Date: Sep. 6, 2012.

(Continued)

*Primary Examiner* — Nalini Mummalaneni
(74) *Attorney, Agent, or Firm* — Cozen O'Connor

(57) ABSTRACT

A display device is characterized by including a first storage section (60) for storing first image data which a display element displays on the display screen next, a second storage section (61) for storing second image data which the display element is displaying on the display screen, a difference calculation section (71) for calculating the difference data between the second image data and the first image data, a third storage means (62) for storing the difference data calculated by the difference calculation section, and a control section for controlling a current value or writing time and the direction in which a writing current is supplied to the display element according to the difference data.

2 Claims, 12 Drawing Sheets

(56) References Cited

U.S. PATENT DOCUMENTS

| | | | | |
|---|---|---|---|---|
| 2002/0105509 | A1* | 8/2002 | Johnson et al. | 345/204 |
| 2002/0190940 | A1* | 12/2002 | Itoh et al. | 345/87 |
| 2004/0150585 | A1 | 8/2004 | Tomisawa | 345/6 |
| 2004/0263461 | A1* | 12/2004 | Park | 345/98 |
| 2005/0035962 | A1 | 2/2005 | Ishibashi et al. | 345/419 |
| 2006/0038799 | A1 | 2/2006 | Tanaka et al. | |
| 2006/0187185 | A1* | 8/2006 | Yoshinaga et al. | 345/107 |
| 2007/0067745 | A1* | 3/2007 | Choi et al. | 715/863 |
| 2007/0200839 | A1* | 8/2007 | Sampsell | 345/204 |

FOREIGN PATENT DOCUMENTS

| | | | |
|---|---|---|---|
| JP | 3428603 | B2 | 5/2003 |
| JP | 2003-241227 | A | 8/2003 |
| JP | 2004-226835 | A | 8/2004 |
| JP | 2005-055567 | A | 3/2005 |
| JP | 2005-115066 | | 4/2005 |
| JP | 2005-292584 | * | 10/2005 |
| JP | 2005-292584 | A | 10/2005 |
| WO | WO 2004/067673 | A1 | 8/2004 |
| WO | WO 2004/068231 | A1 | 8/2004 |
| WO | WO 2009/101851 | A1 | 8/2009 |

OTHER PUBLICATIONS

Minshull, J.F., et al., "Update Control for a Low Speed Display", IBM Technical Disclosure Bulletin, vol. 26, No. 8, Jan. 1, 1984, pp. 4288-4291, Date: Jan. 1984.

Office Action (dated Jul. 31, 2012) from the Japanese Patent Office for corresponding Japanese Patent Application No. 2009-553385, Date: Jul. 31, 2012.

* cited by examiner

FIG. 10a

51

| | | | | | | | | | | | | | | | | | | | | | | | | | |
|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 4 | 6 | 6 | 4 | 0 | 0 | 0 | 0 | 0 | 0 | 0 | 0 | 0 | 0 | 0 | 0 | 0 | 0 |
| 0 | 0 | 0 | 0 | 0 | 0 | 0 | 6 | 6 | 6 | 6 | 6 | 6 | 0 | 0 | 0 | 0 | 0 | 0 | 0 | 0 | 0 | 0 | 0 | 0 | 0 |
| 0 | 0 | 0 | 0 | 0 | 0 | 4 | 6 | 6 | 6 | 6 | 6 | 6 | 4 | 0 | 0 | 0 | 0 | 0 | 0 | 0 | 0 | 0 | 0 | 0 | 0 |
| 0 | 0 | 0 | 0 | 0 | 0 | 6 | 6 | 6 | 6 | 6 | 6 | 6 | 6 | 0 | 0 | 0 | 0 | 0 | 0 | 0 | 0 | 0 | 0 | 0 | 0 |
| 0 | 0 | 0 | 0 | 0 | 0 | 6 | 6 | 6 | 6 | 6 | 6 | 6 | 6 | 0 | 0 | 0 | 0 | 0 | 0 | 0 | 0 | 0 | 0 | 0 | 0 |
| 0 | 0 | 0 | 0 | 0 | 0 | 6 | 6 | 6 | 6 | 6 | 6 | 6 | 6 | 0 | 0 | 0 | 0 | 0 | 0 | 0 | 0 | 0 | 0 | 0 | 0 |
| 0 | 0 | 0 | 0 | 0 | 0 | 4 | 6 | 6 | 6 | 6 | 6 | 6 | 4 | 0 | 0 | 0 | 0 | 0 | 0 | 0 | 0 | 0 | 0 | 0 | 0 |
| 0 | 0 | 0 | 0 | 0 | 0 | 0 | 6 | 6 | 6 | 6 | 6 | 6 | 0 | 0 | 0 | 0 | 0 | 0 | 0 | 0 | 0 | 0 | 0 | 0 | 0 |
| 0 | 0 | 0 | 0 | 0 | 0 | 0 | 0 | 4 | 6 | 6 | 4 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 10b

| | | | | | | | | | | | | | | | | | | | | | | | | | |
|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 8 | 10 | 10 | 8 | 0 | 0 | 0 | 0 | 0 | 0 | 0 | 0 | 0 | 0 | 0 | 0 | 0 | 0 |
| 0 | 0 | 0 | 0 | 0 | 0 | 0 | 10 | 10 | 10 | 10 | 10 | 10 | 0 | 0 | 0 | 0 | 0 | 0 | 0 | 0 | 0 | 0 | 0 | 0 | 0 |
| 0 | 0 | 0 | 0 | 0 | 0 | 8 | 10 | 10 | 10 | 10 | 10 | 10 | 8 | 0 | 0 | 0 | 0 | 0 | 0 | 0 | 0 | 0 | 0 | 0 | 0 |
| 0 | 0 | 0 | 0 | 0 | 0 | 10 | 10 | 10 | 10 | 10 | 10 | 10 | 10 | 0 | 0 | 0 | 0 | 0 | 0 | 0 | 0 | 0 | 0 | 0 | 0 |
| 0 | 0 | 0 | 0 | 0 | 0 | 10 | 10 | 10 | 10 | 10 | 10 | 10 | 10 | 0 | 0 | 0 | 0 | 0 | 0 | 0 | 0 | 0 | 0 | 0 | 0 |
| 0 | 0 | 0 | 0 | 0 | 0 | 10 | 10 | 10 | 10 | 10 | 10 | 10 | 10 | 0 | 0 | 0 | 0 | 0 | 0 | 0 | 0 | 0 | 0 | 0 | 0 |
| 0 | 0 | 0 | 0 | 0 | 0 | 8 | 10 | 10 | 10 | 10 | 10 | 10 | 8 | 0 | 0 | 0 | 0 | 0 | 0 | 0 | 0 | 0 | 0 | 0 | 0 |
| 0 | 0 | 0 | 0 | 0 | 0 | 0 | 10 | 10 | 10 | 10 | 10 | 10 | 0 | 0 | 0 | 0 | 0 | 0 | 0 | 0 | 0 | 0 | 0 | 0 | 0 |
| 0 | 0 | 0 | 0 | 0 | 0 | 0 | 0 | 8 | 10 | 10 | 8 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 10c

| | | | | | | | | | | | | | | | | | | | | | | | | | |
|---|---|---|---|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 4 | 4 | 4 | 4 | 0 | 0 | 0 | 0 | 0 | 0 | 0 | 0 | 0 | 0 | 0 | 0 | 0 | 0 |
| 0 | 0 | 0 | 0 | 0 | 0 | 0 | 4 | 4 | 4 | 4 | 4 | 4 | 0 | 0 | 0 | 0 | 0 | 0 | 0 | 0 | 0 | 0 | 0 | 0 | 0 |
| 0 | 0 | 0 | 0 | 0 | 0 | 4 | 4 | 4 | 4 | 4 | 4 | 4 | 4 | 0 | 0 | 0 | 0 | 0 | 0 | 0 | 0 | 0 | 0 | 0 | 0 |
| 0 | 0 | 0 | 0 | 0 | 0 | 4 | 4 | 4 | 4 | 4 | 4 | 4 | 4 | 0 | 0 | 0 | 0 | 0 | 0 | 0 | 0 | 0 | 0 | 0 | 0 |
| 0 | 0 | 0 | 0 | 0 | 0 | 4 | 4 | 4 | 4 | 4 | 4 | 4 | 4 | 0 | 0 | 0 | 0 | 0 | 0 | 0 | 0 | 0 | 0 | 0 | 0 |
| 0 | 0 | 0 | 0 | 0 | 0 | 4 | 4 | 4 | 4 | 4 | 4 | 4 | 4 | 0 | 0 | 0 | 0 | 0 | 0 | 0 | 0 | 0 | 0 | 0 | 0 |
| 0 | 0 | 0 | 0 | 0 | 0 | 4 | 4 | 4 | 4 | 4 | 4 | 4 | 4 | 0 | 0 | 0 | 0 | 0 | 0 | 0 | 0 | 0 | 0 | 0 | 0 |
| 0 | 0 | 0 | 0 | 0 | 0 | 0 | 4 | 4 | 4 | 4 | 4 | 4 | 0 | 0 | 0 | 0 | 0 | 0 | 0 | 0 | 0 | 0 | 0 | 0 | 0 |
| 0 | 0 | 0 | 0 | 0 | 0 | 0 | 0 | 4 | 4 | 4 | 4 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 13a
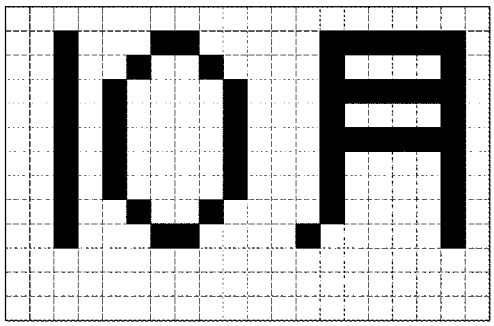
FIG. 13b
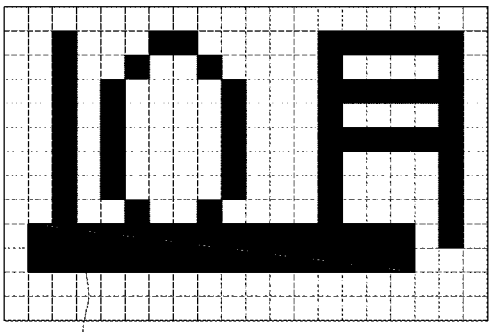
FIG. 13c
| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 10 | 0 | 0 | 0 | 10 | 10 | 0 | 0 | 0 | 0 | 0 | 10 | 10 | 10 | 10 | 10 | 10 | 0 |
| 0 | 0 | 10 | 0 | 0 | 10 | 0 | 0 | 10 | 0 | 0 | 0 | 0 | 10 | 0 | 0 | 0 | 0 | 10 | 0 |
| 0 | 0 | 10 | 0 | 10 | 0 | 0 | 0 | 0 | 10 | 0 | 0 | 0 | 10 | 10 | 10 | 10 | 10 | 10 | 0 |
| 0 | 0 | 10 | 0 | 10 | 0 | 0 | 0 | 0 | 10 | 0 | 0 | 0 | 10 | 0 | 0 | 0 | 0 | 10 | 0 |
| 0 | 0 | 10 | 0 | 10 | 0 | 0 | 0 | 0 | 10 | 0 | 0 | 0 | 10 | 10 | 10 | 10 | 10 | 10 | 0 |
| 0 | 0 | 10 | 0 | 10 | 0 | 0 | 0 | 0 | 10 | 0 | 0 | 0 | 10 | 0 | 0 | 0 | 0 | 10 | 0 |
| 0 | 0 | 10 | 0 | 10 | 0 | 0 | 0 | 0 | 10 | 0 | 0 | 0 | 10 | 0 | 0 | 0 | 0 | 10 | 0 |
| 0 | 0 | 10 | 0 | 0 | 10 | 0 | 0 | 10 | 0 | 0 | 0 | 0 | 10 | 0 | 0 | 0 | 0 | 10 | 0 |
| 0 | 0 | 10 | 0 | 0 | 0 | 10 | 10 | 0 | 0 | 0 | 0 | 10 | 0 | 0 | 0 | 0 | 0 | 10 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
FIG. 13d
| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 10 | 0 | 0 | 0 | 10 | 10 | 0 | 0 | 0 | 0 | 0 | 10 | 10 | 10 | 10 | 10 | 10 | 0 |
| 0 | 0 | 10 | 0 | 0 | 10 | 0 | 0 | 10 | 0 | 0 | 0 | 0 | 10 | 0 | 0 | 0 | 0 | 10 | 0 |
| 0 | 0 | 10 | 0 | 10 | 0 | 0 | 0 | 0 | 10 | 0 | 0 | 0 | 10 | 10 | 10 | 10 | 10 | 10 | 0 |
| 0 | 0 | 10 | 0 | 10 | 0 | 0 | 0 | 0 | 10 | 0 | 0 | 0 | 10 | 0 | 0 | 0 | 0 | 10 | 0 |
| 0 | 0 | 10 | 0 | 10 | 0 | 0 | 0 | 0 | 10 | 0 | 0 | 0 | 10 | 10 | 10 | 10 | 10 | 10 | 0 |
| 0 | 0 | 10 | 0 | 10 | 0 | 0 | 0 | 0 | 10 | 0 | 0 | 0 | 10 | 0 | 0 | 0 | 0 | 10 | 0 |
| 0 | 0 | 10 | 0 | 10 | 0 | 0 | 0 | 0 | 10 | 0 | 0 | 0 | 10 | 0 | 0 | 0 | 0 | 10 | 0 |
| 0 | 0 | 10 | 0 | 0 | 10 | 0 | 0 | 10 | 0 | 0 | 0 | 0 | 10 | 0 | 0 | 0 | 0 | 10 | 0 |
| 0 | 6 | 6 | 6 | 6 | 6 | 6 | 6 | 6 | 6 | 6 | 6 | 6 | 6 | 6 | 6 | 6 | 0 | 10 | 0 |
| 0 | 6 | 6 | 6 | 6 | 6 | 6 | 6 | 6 | 6 | 6 | 6 | 6 | 6 | 6 | 6 | 6 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
FIG. 13e
| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 6 | -4 | 6 | 6 | 6 | -4 | -4 | 6 | 6 | 6 | -4 | 6 | 6 | 6 | 6 | 6 | 0 | 0 | 0 |
| 0 | 6 | 6 | 6 | 6 | 6 | 6 | 6 | 6 | 6 | 6 | 6 | 6 | 6 | 6 | 6 | 6 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

DISPLAY DEVICE

RELATED APPLICATIONS

This application is a U.S. National Phase Application under 35 U.S.C. 371 of International Application No. PCT/JP2009/051071, filed with Japanese Patent Office on Jan. 23, 2009, which claims priority to Japanese Patent Application No. 2008-031533, filed Feb. 13, 2008.

TECHNICAL FIELD

The present invention relates to a display device.

BACKGROUND ART

With the improvement of the operation speed of a personal computer, spread of the network infrastructure, an increase in data storage capacity and a reduction in prices of data storage in recent years, there has been increasing occasions of obtaining and viewing the simpler electronic information of documents and images and the like which used to be provided in a form of a printed copy in the conventional manner.

A conventional liquid crystal display, a CRT and, in recent years, a light emitting type display such as an organic EL display have been used as a means for viewing electronic information. However, when the electric information is text information, the viewing device must be gazed at for a comparatively long period of time, and this action is not very human friendly.

Generally, the known disadvantages of the light-emitting type display include visual fatigue caused by flicker, poor portability, restricted posture for viewing so as to put the line of sight on a still image, and an increase in power consumption when viewed for a long period of time.

One of the known devices to measure these disadvantages is a (memory-type) reflective display that uses the external light consuming no power to maintain images. However, this kind of device does not provide satisfactory performances for the following reasons.

The method of using the polarizing plate such as a reflective liquid crystal has a low reflectivity of about 40 percent, and therefore has a problem when displaying white color. Many of the manufacturing methods of the components are not very easy or simple. Further, since the polymer dispersed liquid crystal display requires a high voltage, and the contrast of the obtained image is not sufficiently high because it uses the difference in the refractive indexes of organic materials. The polymer network liquid crystal display requires a high driving voltage and a complicated TFT circuit for a better memory characteristic. The display element using an electrophoresis method requires a high voltage of 10 volts or more. There is a concern about the durability resulting from aggregation of electrophoretic particles.

The display methods known to overcome the drawbacks of the aforementioned types include the electrochromic display element (hereinafter abbreviated as "EC type") and electrodeposition type using solution and deposition of metals or metallic salts (hereinafter abbreviated as "ED type").

The EC type is capable of full-color display by a low voltage of 3 volts or less, and is characterized by simple cell configuration and excellent white color quality. Similarly, the ED type is capable of driving by a low voltage of 3 volts or less, and is characterized by simple cell configuration, excellent black-and-white contrast and black color quality. Various methods of those types have been proposed (see Patent Literatures 1 through 5 for example).

As described above, the EC type and ED type are capable of being driven by a low voltage of 3 volts or less, and is characterized by simple cell configuration, excellent display quality and paper-like white and crisp black quality.

Patent Literature 1: International Publication No. WO2004/068231

Patent Literature 2: International Publication No. WO2004/067673

Patent Literature 3: U.S. Pat. No. 4,240,716

Patent Literature 4: Japanese Registration Patent No. 3428603

Patent Literature 5: Japanese Unexamined Patent Application Publication No. 2003-241227

DISCLOSURE OF THE INVENTION

Object of the Invention

In recent years, there has been a demand for a color display in addition to the above-de scribed features of the white-and-black display. For example, when a color display is used in the tablet PC, additional lines can be overwritten in a different color on the displayed text by handwriting input.

However, the EC type requires three layers of different colors to be laminated. Thus, there is a concern about cost increase due to the complicated element structure. The present inventors have improved the ED type and have developed a display element of SECD (Silver Electric Chromic Deposition Display) where a layer containing an electrolyte and electrochromic compound is sandwiched between the opposing electrodes, and the color of the electrochromic compound is changed by the drive operation of the opposing electrodes. This has realized the gradation display of white, black and other colors.

Similarly to the general memory type display element, the SECD provides a memory function where a predetermined display state is maintained by maintaining the chemical and mechanical state in the displayed state. However, the maintained display state can undergo subtle changes in response to various parameters such as temperature and atmospheric pressure. Therefore, precise gradation control is difficult in the memory-type element including the SECD.

To solve such problems, every time the display screen is updated, the displayed image of the memory type display element is once reset to the initial state such as white state. After that, the screen to be displayed is again written, whereby the gradation of the entire screen is accurately reproduced.

Assuming that erasing and writing of the display screen each requires 0.5 seconds, for example, the user is required to wait for a total of one second when an addition writing and partial rewriting is done.

When used in the tablet PC display, the response and the usability is poor, because a long waiting time is required every time data is inputted by handwriting or the button appearing on the screen is clicked.

In view of the problems described above, it is an object of the present invention to provide a reflection type display device which is required for a quick response rather than gradation representation and is capable of display with quick response to the button operation and handwriting input.

Means for Solving the Problems

The object of the present invention is achieved by the following structures.

Item 1. A display device which has a display screen including display elements arranged in a matrix, and is configured to display an image by each of the display elements being supplied with a writing current wherein a value of the writing current or a writing time is varied depending on density of the image to be displayed, the display device comprising:

a first storage section configured to store first image data which is going to be displayed next on the display screen by the display elements;

a second storage section configured to store second image data displayed on the display screen by the display elements;

a difference calculation section configured to calculate difference data between the second image data and the first image data;

a third storage section configured to store the difference data calculated by the difference data calculation section; and a control section configured to control, based on the difference data, the value of the current or the writing time, and a supply direction of the writing current supplied to the display element.

Item 2. The display device of item 1, comprising:

an input section configured to indicate a position or an area on the display screen, wherein when the control section determines that an input operation is performed by the input section, the control section stores data which is going to be displayed in response to the input operation in a specific area by the display elements, in the first storage section; store the second image data displayed in the specific area by the display elements; and then rewrites the display elements in the specific area based on the difference data calculated by the difference calculation section.

Item 3. The display device of item 2, wherein other than when the control section determines that an input operation by the input section is performed, the control section (i) stores initialization data for whole area of the display screen, in the first storage section, (ii) stores the second image data displayed on the display screen by the display elements, in the second storage section, (iii) rewrites the display elements of the display screen based on difference data between the second image data and the first image data, (iv) then stores data which is going to be displayed by the display elements, in the first storage section, (v) stores the image data displayed by the display elements, and (vi) rewrites the display elements based on the difference data calculated by the difference calculation section.

Item 4. The display device of item 1, comprising:

a constant current circuit configured to be capable of supplying the writing current, depending on an applied control voltage, in such a direction that the density of the display element is increased and in such a direction that the density of the display element is decreased;

a switching element configured to control applying and cutting of the control voltage;

a driver circuit configured to apply the control voltage through the switching element;

a control voltage power source configured to supply the control voltage to the driver circuit;

a common power source configured to apply a common voltage to the display elements so as to let the writing current flow in such a direction that the density of the display element is increased or in such a direction that the density of the display element is decreased, wherein the control section controls in such a way that the value of the current or the writing time, and the common voltage are set based on the difference data, and the predetermined writing current is supplied to the display elements.

Effects of the Invention

According to the present invention, provided is a reflection type display device capable of quick response.

BRIEF DESCRIPTION OF THE DRAWINGS

FIGS. 10*a*, 10*b*, and 10*c* is a schematic diagram representing the image data showing the handwriting button 51;

FIGS. 13*a* to 13*e* are schematic diagrams representing a handwriting input image displayed on a display screen 50 and an image data of the corresponding pixels.

DESCRIPTION OF THE NUMERALS

Figure 1:
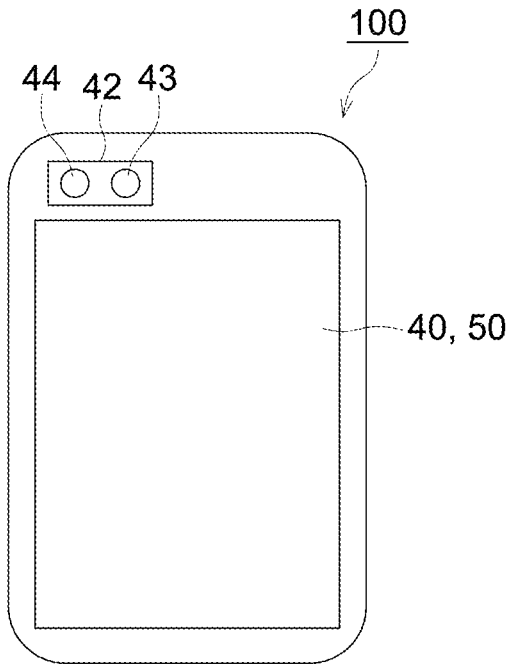
FIG. 1 is an external view representing an example of a display device of an embodiment according to the present invention.

1. Display element
2. Drive transistor
3. Auxiliary capacity
4. Switching transistor
5*a*, 5*b*, 5*c*. Scanning lines
8*a*, 8*b*, 8*c*. Signal lines
10. Storage section
11. Control section
12. Gate driver
13. Common power source
14. Source driver
20. Constant current circuit
30. Silver electrode
31. Electrolyte
32. ITO electrode
33. Current source
60. 1st frame memory
61. 2nd frame memory
62. 3rd frame memory
71. Difference calculation section

BEST MODE FOR CARRYING OUT THE INVENTION

The following describes an embodiment of the present invention with reference to the drawings, without the present invention being restricted thereto.

The first embodiment will be described with reference to FIG. 1

FIG. 1 is an external view representing an example of a display device of an embodiment according to the present invention.

A display device 100 is exemplified by a tablet PC, electronic book and PDA, and data such as images and characters stored in a storage section 10 not illustrated in FIG. 1 is displayed on a display screen 50. A memory type display element capable of gradation display of white, black and other colors, for example, a SECD is used for the display screen 50. An operation section 42 is provided with a forward feed button 43 and a backward feed button 44 made up of mechanical switches. For example, when the user presses the forward feed button 43, the data for the page next to the page of the data displayed on the display screen 50 is read out of the storage section 10 and is displayed. Similarly, when the user presses the backward feed button 44, the data for the page previous to the page of the data displayed on the display screen 50 is read out of the storage section 10 and is displayed.

On the upper layer of the display screen 50 is a touch panel 40. After the user switches the mode to a handwriting mode by the input operation on the touch panel 40, the user designates a position or a region on the screen to perform handwriting input. For the input operation on the touch panel 40, a stylus pen 55 not illustrated in FIG. 1 can be used, or the touch panel 40 can be operated directly by hand. The touch panel 40 is an input section according to the present invention.

Figure 2:
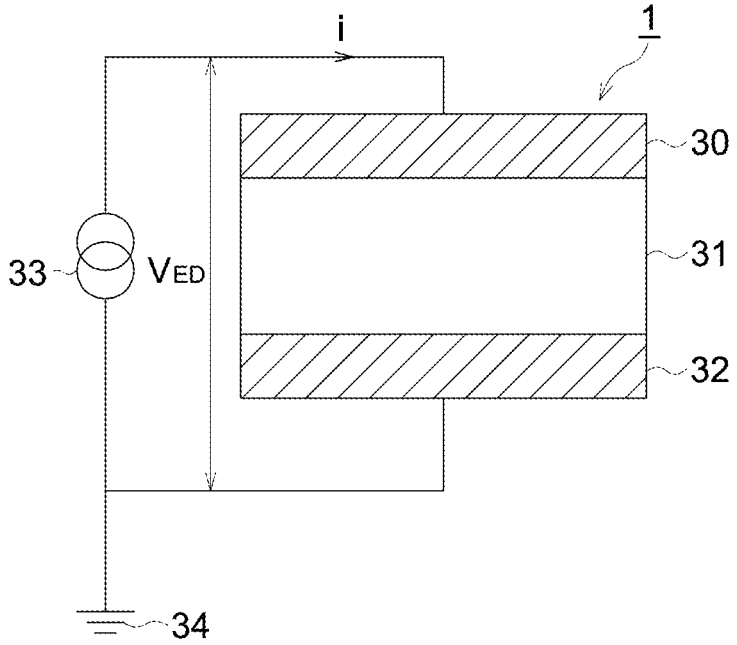
FIG. 2 is a schematic cross sectional view showing a basic structure of an SECD of an embodiment of the display element 1 according to the present invention.

FIG. 2 is a schematic cross sectional view showing a basic structure of the SECD in an embodiment according to the present invention.

The display element 1 of FIG. 2 holds the electrolyte 31 between a transparent ITO electrode 32 and a silver electrode 30. A current source 33 is connected to the transparent ITO electrode 32 and the silver electrode 30. When current i is supplied from a current source 33 to the silver electrode 30, the silver contained in the electrolyte 31 is segregated. The segregated silver absorbs light and there will be an increase in the density of the display element 1 as viewed from the ITO electrode 32, so that the color appears black. In the SECD, the electrolyte 31 containing the electrochromic compound is used. Accordingly, there is color development in response to the supplied current i, thereby permitting color display in addition to the black and white gradation.

When current i is supplied to the silver electrode 30 from the current source 33 in the direction reverse to the arrow-marked direction in the diagram, the silver contained in the electrolyte 31 starts to dissolve. The segregated silver changes transparent. The electrolyte 31 of the SECD contains white scatterers (titanium oxide and others). Since light is reflected by the scatterers, the color seems white from outside. Thus, when current i is supplied for a predetermined time in the direction reverse to the arrow-marked direction in the drawing, the density and color of the display element 1 as viewed from the ITO electrode 32 turns white which is an initial state. $V_{ED}$ indicates the voltage between the ITO electrode 32 and silver electrode 30 when current i is supplied.

The electrolyte 31 contained in the display element 1 can be prepared by, for example, phase change of silver from aqueous solution of silver salt to non-aqueous solution of silver salt. Such an aqueous solution of silver salt can be prepared by dissolving the known silver salt in water. Further, any compound can be used as the electrochromic compound if it shows a phenomenon (electrochromism) that shows a reversible change of optical absorption properties of the substance (such as color and optical transmittance) by electrochemical oxidation-reduction. Specific examples of the compound are shown in the "Electrochromic Display" (Jun. 28, 1991, Sangyo Tosho Co., Ltd.), pp. 27-124, and "Development of Chromic Material" (Nov. 15, 2000, CMC), pp. 81-95.

In the present embodiment, the following describes an example of color display using the SECD, without the application of the present invention being restricted to the SECD. Any display element can be used if it permits color display in addition to the black-and-white gradation by applying the writing current while changing the current value or writing time. Further, this method is also applicable to the case where black-and-white display is to be performed using the electrochemical element based on the known ED type or EC type.

Figure 3:
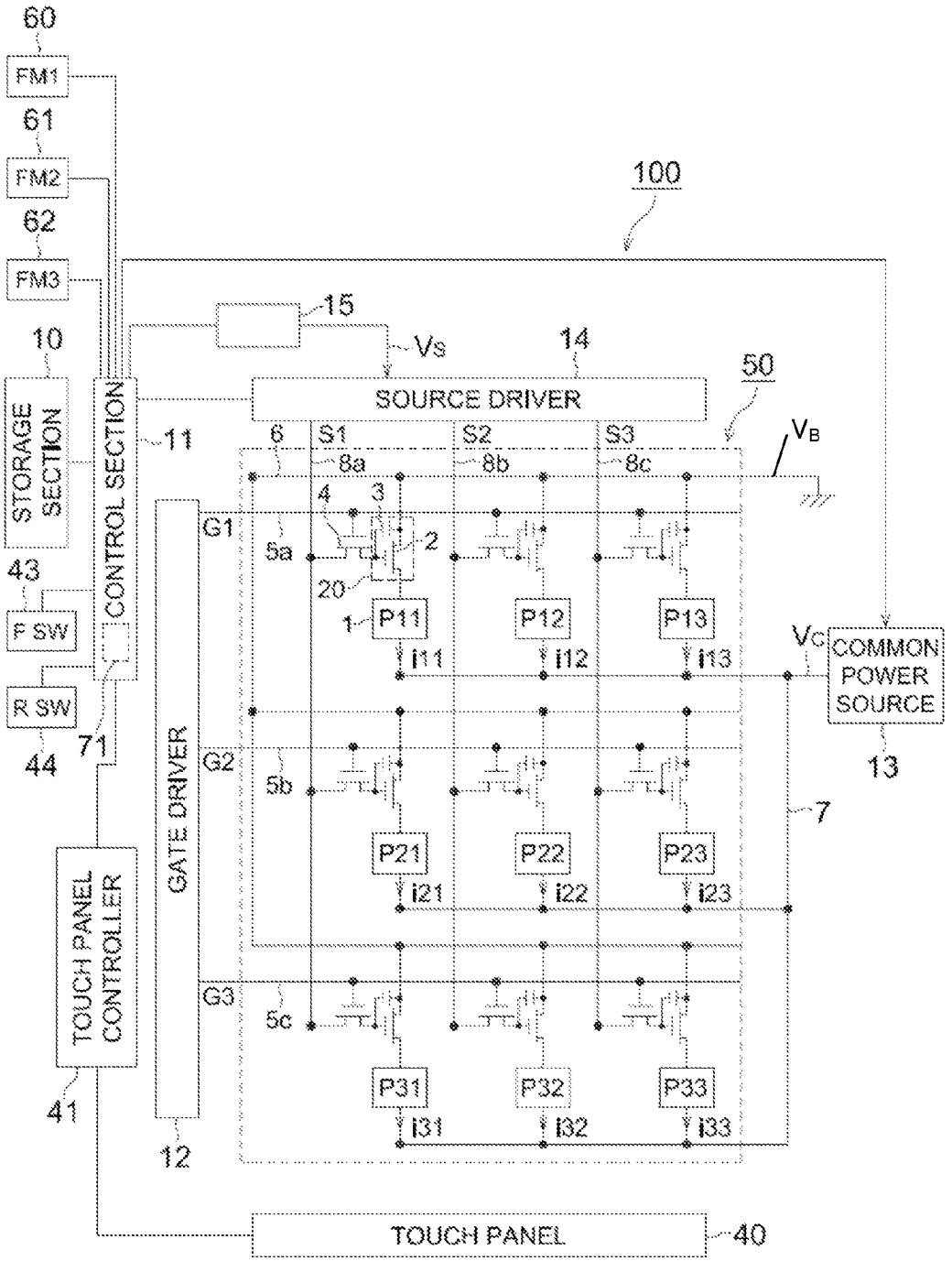
FIG. 3 is a diagram representing an structure of a display device in an embodiment of the present invention.

FIG. 3 is a diagram representing the structure of the display device in the embodiment according to the present invention. For ease of explanation, FIG. 3 shows the structure of a display device having a 3 row by 3 column pixel matrix. The present invention, however, is not restricted to this number of pixels. It is applicable to display devices having pixels with n rows and m columns.

Each pixel has a display element 1, a drive transistor 2, an auxiliary capacity 3 and a switching transistor 4. In FIG. 3, each of the display elements 1 in the 3 row by 3 column matrix is shown as Pnm, where m, n=1, 2, 3. For example, the display element at row 1 and column 1 is shown as P11, the pixel at row 1 and column 2 is shown as P12, in that order.

Reference symbols 5*a*, 5*b* and 5*c* indicate scanning lines, which connect the gates of the switching transistors 4 of the pixels arranged in the row direction, and are connected to a gate driver 12. Reference symbols 8*a*, 8*b* and 8*c* indicate signal lines, which connect the sources of the switching transistors 4 of the pixels arranged in the column direction, and are connected to a source driver 14. The gate driver 12 supplies the output voltages G1, G2 and G3 to the scanning lines 5*a*, 5*b* and 5*c*, whereby on/off control of the switching transistor 4 is conducted so as to select the row to which a control voltage is applied. The switching transistor 4 of the present embodiment corresponds to a switching element of the present invention.

The source driver 14 has a driver circuit for each of the signal lines 8*a*, 8*b* and 8*c*, and supplies output voltages S1, S2 and S3 to the signal lines 8*a*, 8*b* and 8*c* connected to the output side thereof, under the control of a control section 11. The driver circuit of the source driver 14 is an on/off binary driver, and outputs the control voltage Vs input into the source driver 14 or the off-state voltage of 0 volt, under the control of the control section 11. The source driver 14 in this embodiment corresponds to a driver circuit of the present invention.

The control voltage power source 15 is provided with a digital-to-analog converter and others, and outputs the control voltage Vs, which is supplied to the source driver 14. The control voltage power source 15 of the present embodiment corresponds to a control voltage power source of the present invention.

The control section 11 includes a CPU and a controller for driving pixels, and controls the display device as a whole according to a program stored in a storage section 10. The control section 11 corresponds to a control device of the present invention. The storage section 10 has a storage medium such as an ROM (Read Only Memory) or a flash memory. The CPU of the control section 11 has a difference calculation section 71 for calculating the difference data between the 1st frame memory 60 and 2nd frame memory 61. The difference calculation section 71 of the present embodiment corresponds to a difference calculation device of the present invention.

Each of the 1st frame memory 60, 2nd flame memory 61 and 3rd frame memory 62 is a frame memory for one screen and has a storage area corresponding to the number of pixels of the display screen 50. The 1st frame memory 60 stores the data of the first image which the display elements 1 display on the display screen 50 at the next time. The 2nd frame memory 61 stores the data of the second image which the display elements 1 are currently displaying n the display screen 50. The difference calculation section 71 reads out the second image data and the first image data of the corresponding pixels from the 2nd frame memory 61 and the 1st frame memory 60, and calculates the difference data, which is then stored in the 3rd frame memory 62. The 1st frame memory 60, the 2nd frame memory 61 and the 3rd frame memory 62 of the present embodiment correspond to a first storage section, a second storage section and a third storage section of the present invention, respectively. In the drawing, the 1st frame memory 60, the 2nd frame memory 61 and the 3rd frame memory 62 are described as FM1, FM2 and FM3, respectively.

The touch panel controller 41 scans the input area of the touch panel 40. The positional information of the position at which an input operation was made to the touch panel 40 is sent to the control section 11. The touch panel 40 of the present embodiment corresponds to an input section of the present invention.

The forward feed button 43 and backward feed button 44 are made up of mechanical switches. The control section 11 detects their on/off states.

The identical circuit structure is used for each pixel. Referring to FIG. 3, the following describes the pixel at first row and first column as an example.

The constant current circuit 20 is made up of a drive transistor 2 and an auxiliary capacity 3. The source of the drive transistor 2 is connected to the bus line 6, and the drain is connected to the silver electrode 30 of the display element 1. The auxiliary capacity 3 is connected between the source and gate of the drive transistor 2, and holds the control voltage Vs applied between the source and the gate. The bus line 6 is a 0-volt line connected to the GND (ground). The drive transistor 2 supplies the constant current to the display element 1 in response to 0 volt and the control voltage Vs applied between the gate and the source. The constant current circuit 20 of the present embodiment corresponds to a constant current circuit of the present invention.

The source of the switching transistor 4 is connected to the signal line 8*a*, the drain is connected to the gate of the drive transistor 2 and the auxiliary capacity 3, and the gate is connected to the gate driver 12. When the output voltage G1 of the gate driver 12 goes "H", the switching transistor 4 turns on. The output voltage S1 of the source driver 14 is applied to the gate of the drive transistor 2 and the auxiliary capacity 3.

A common electrode 7 is connected to the display element 1 of each pixel, and one end thereof is connected to the common power source 13. In response to the instruction from the control section 11, the common power source 13 outputs a positive or negative voltage Vc. The common power source 13 of the present embodiment corresponds to a common power source of the present invention.

Figure 4:
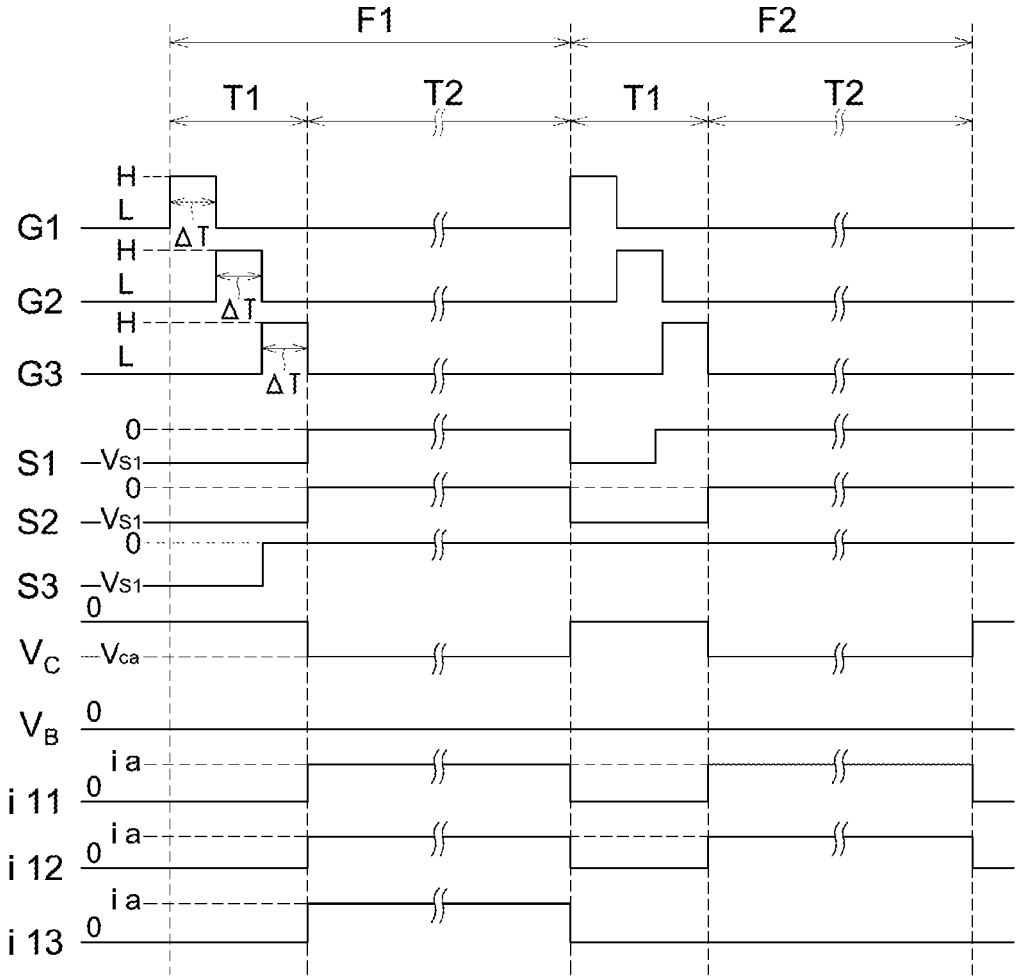
FIG. 4 is a timing diagram showing changes in voltage in each section during a writing operation of the display device of an embodiment according to the present invention.
Figure 5:
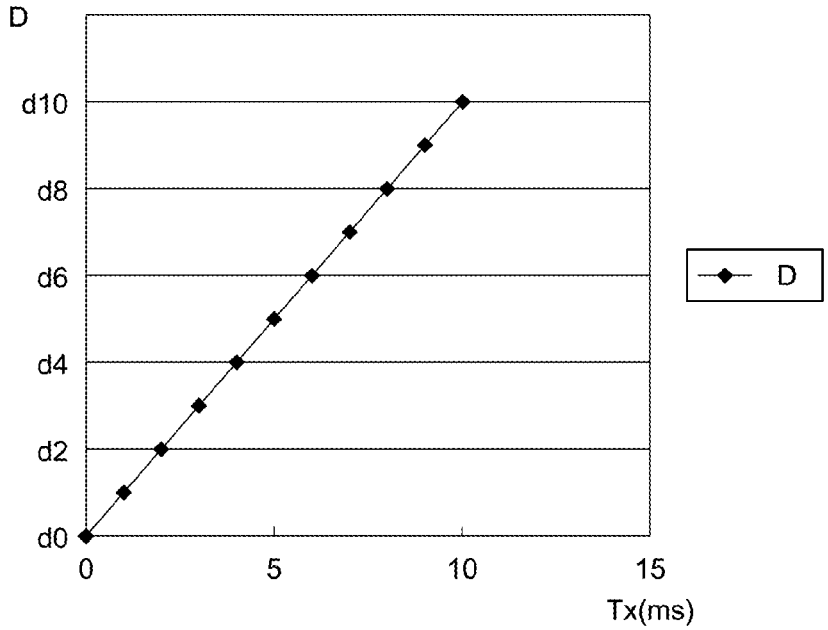
FIG. 5 is a chart showing the relationship between a writing time Tx during the writing operation and a display density D of the display device of the present embodiment.
Figure 6:
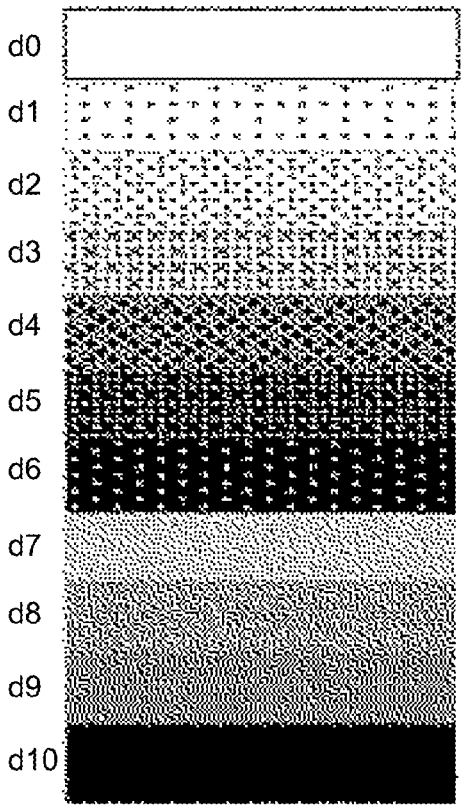
FIG. 6 is a diagram describing the display density D of the display device of the present embodiment.

Referring to FIGS. 4, 5 and 6, the following describes a writing operation of the display device according to the present invention.

FIG. 4 is a timing diagram showing changes in voltage in each section during the writing operation of the display device in an embodiment of the present invention. FIG. 5 is a chart showing the relationship between the writing time Tx during the writing operation and the display density D of the display device of the present embodiment. FIG. 6 is a diagram describing the display density D of the display element 1 of the present embodiment.

As shown in FIG. 5, in the display element 1 of the present embodiment, when a constant writing current is supplied, the display density D increases in proportion to the writing time Tx. The d0 through d10 on the vertical axis indicate the density value. As shown in FIG. 6, d0 provides the minimum density, which looks white. The d10 provides the maximum density, which looks black. In the intermediate range from d1 through d6, the black-and-white gradations are colored in red. The d6 appears pure red. In the range from d7 through d10, black-and-white gradations are reproduced.

The timing diagram of FIG. 4 is used for the following description: In the timing diagram of FIG. 4, the density value of the display element 1 is assumed as d0 before an image is written in the display element 1.

The T1 of FIG. 4 is a programming time for setting the control voltage Vs of the constant current circuit 20 of each pixel. T2 is the writing time, and indicates a unit time for supplying currents i11 through i33 to the respective display elements 1 of the pixels. In the display device of the present embodiment, the frame having the T1 and T2 is implemented several times, whereby a desired display density D is obtained. For example, T1 is 1 ms and T2 is 100 ms, where the time T1 is much shorter than T2.

F1 of FIG. 4 is a frame time of the first frame, and F2 is a frame time of the second frame. In the first place, the program time of the first frame of FIG. 4 will be explained.

During T1, $V_B$ and $V_C$ are 0 volt, and currents i11 through i33 of the display element 1 of each pixel are 0. To simplify the drawing, FIG. 4 shows only the timing diagram of i11, i12 and i13.

In the first part of the first frame, the output voltage G1 of the gate driver 12 goes "H" during the ΔT. During this time, G2 and G3 are "L". "H" indicates the voltage for turning on the switching transistor 4, and "L" shows the voltage for turning off the switching transistor 4.

In the example of FIG. 4, output voltages S1, S2 and S3 are −Vs1 during this time. The voltage between the gate and source of the drive transistor 2 connected to the P11, P12 and P13 is set to −Vs1, and is held in the auxiliary capacity 3.

Then the output voltage G2 of the gate driver 12 goes "H" during ΔT. During this time, G1 and G3 are "L". In the example of FIG. 4, the output voltages S1, S2 and S3 are −Vs1 during this time. The voltage between the gate and the source of the drive transistor 2 connected to the P21, P22 and P23 is set to −Vs1, and is held in the auxiliary capacity 3.

Then the output voltage G3 of the gate driver 12 goes "H" during ΔT. During this time, G1 and G2 are "L". In the example of FIG. 4, the output voltages S1 and S2 are −Vs1 during this time. The voltage between the gate and the source of the drive transistor 2 connected to the P31, P32 and P33 is set to −Vs1, and is held in the auxiliary capacity 3. During this time the output voltage S3 is zero. The voltage between the gate and source of the drive transistor 2 connected to the P33 is set to 0 volt, and is held in the auxiliary capacity 3.

During the writing time T2, $V_C$ is $-V_{Ca}$, and $V_B$ is 0 volt. A constant current corresponding to the voltage between the gate and the source of the drive transistor 2 held in the auxiliary capacity 3 is supplied to the display element 1. FIG. 4 shows that the current values i11, i12 and i13 of the display element 1 are "ia" during this time. In this example, the current i33 of the display element 1 of P33 is zero (not illustrated), but the other current values of the display elements 1 are "ia". In this example, the density of the display element 1 is d1 when the current "ia" is supplied during T2.

Similarly, in the program time of the second frame, the output voltage G1 of the gate driver 12 goes "H" during ΔT at first. During this time, the G2 and G3 are "L". During this time, output voltage S1 and S2 are −Vs1. The voltage between the gate and the source of the drive transistor 2 connected to the P11 and P12 is set to −Vs1, and is held in the auxiliary capacity 3. Similarly to the case of the first frame, the voltages S1 through S3 where the output voltages G2 and G3 are "H" are set on the constant current circuit 20.

During the writing time T2, a constant current corresponding to the voltage between the gate and the source of the drive transistor 2 held in the auxiliary capacity 3 is supplied to the display element 1. FIG. 4 shows that the current values i11 and i12 of the display element 1 are "ia" during this time, and the current value i13 is 0 during this time. In this example, the density of the display element 1 is d2 when the current "ia" is supplied during T2, also in the second frame.

FIG. 4 shows up to only the second frame. However, it is possible to get display densities d0 through d10 of eleven levels of gradation by applying ten writing operations from F1 through F10 to one pixel, for example.

FIG. 4 illustrates the case of increasing the display density of the display element 1. The following describes the case of reducing the display density of each display element 1. When reducing the display density of each display element 1, the polarities of the common voltage Vc and control voltage Vs are reversed to ensure that the current i of the display element 1 will flow reverse to the direction in FIG. 4. To be more specific, the positive control voltage Vs is held in the auxiliary capacity 3, and the Vc is changed to positive voltage $V_{Ca}$ during the writing time T2. In this manner, when the current is supplied to the display element 1 in the reverse direction during the time T2, the display density of the display element 1 is reduced from d2 to d1, for example.

Figure 7A:
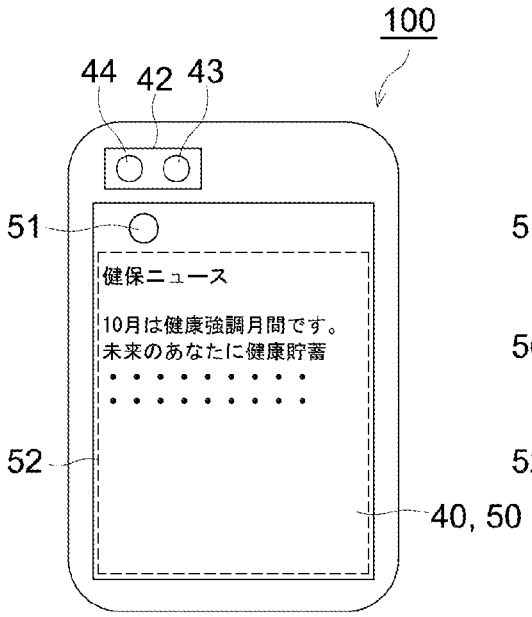
FIGS. 7*a* and 7*b* is an explanatory diagram showing the writing input operation on the display device 100.
Figure 7B:
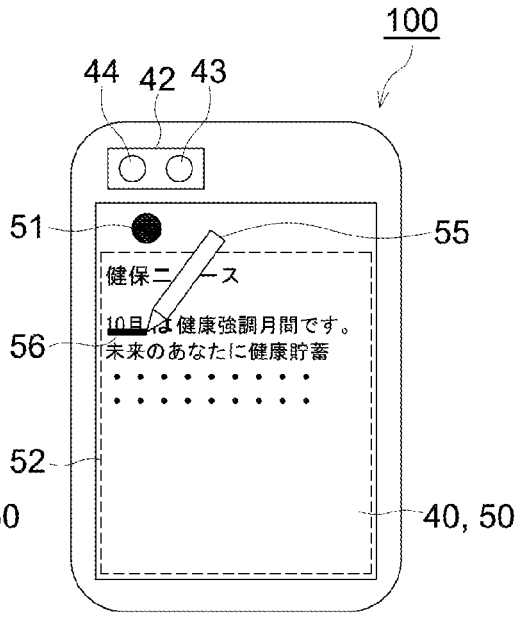

FIGS. 7*a* and 7*b* is explanatory diagrams showing the writing input operation of the display device 100.

FIG. 7*a* shows that text data is displayed in Japanese characters on the display device 100. The area indicated by the dotted line 52 is the text area where the texts of the display screen 50 is displayed. The reference numeral 51 indicates the handwriting button of the GUI displayed on the display screen 50. For example, the handwriting button 51 shown in FIG. 7*a* indicates the state of handwriting input OFF.

The tapping, of the touch panel 40, on the position over the area where the handwriting button 51 is displayed turns on the handwriting input, which action changes the display of the handwriting button 51, as shown in FIG. 7*b*, to red, for example. When the handwriting input is on, handwriting input can be made to the text area 52 using a stylus pen 55 and the like. FIG. 7*b* shows that an underline i56 is drawn on a part of the displayed document. The underline 56 is shown in red, for example, so as to be conspicuous.

The following describes the method of controlling the display device 100.

Figure 8:
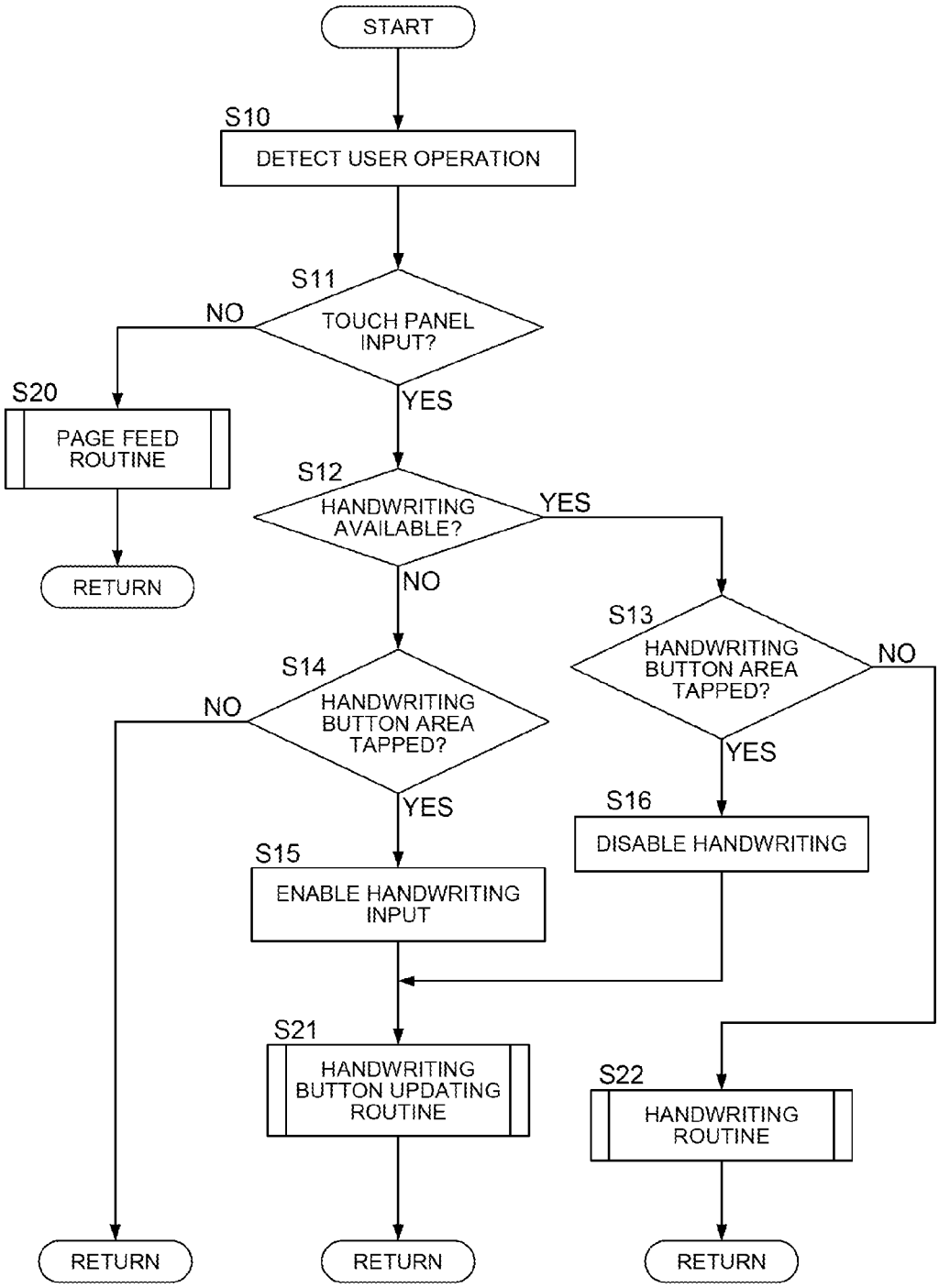
FIG. 8 is a flowchart representing the input control of a display device 100 of the embodiment according to the present invention.

FIG. 8 is a flowchart representing the input control of the display device 100 of the embodiment of the present invention.

The description will be done below in the order of the flow chart of FIG. 8:

S10 is a step where the control section 11 detects the user operation.

The control section 11 monitors the states of the forward feed button 43, the backward feed button 44 and the touch panel controller 4, and detects the user operation, S11 is a step of determining if the input is from the touch panel 40 or not.

The control section 11 determines if the input is from the touch panel 40 or not, and goes on to the next step.

If the input is not one instructed from the touch panel 40 (No in Step S11), the operation goes on to Step S20.

S20 is a step of page feed.

The control section 11 calls a page feed routine to process the handwritten page feed display instructed by the forward feed button 43 or the backward feed button 44.

If the input is one instructed from the touch panel 40 (Yes in Step S11), the operation goes on to Step S12.

S12 is a step of determining if the handwriting button 51 is turned on or not.

If there is an input from the touch panel 40, the control section 11 turns on the handwriting button 51*n*. To be more specific, the control section 11 determines whether or not the display device 100 is set so that the handwriting input is possible.

If the handwriting button 51 is off (No in Step S12), the operation goes on to Step S14.

If the handwriting button 51 is on (Yes in Step S12), the operation goes on to Step S13.

S13 is a step of determining if the area of the handwriting button 51 has been tapped or not.

The control section 11 determines if the area of the handwriting button 51 on the touch panel 40 has been tapped or not If the area of the handwriting button 51 has been tapped (Yes in Step S13), the operation goes on to Step S16.

S16 is a step of disabling the acceptance of a handwriting input.

The control section 11 disables the acceptance of a handwriting input from the touch panel 40 and goes on to the Step S21.

If an area other than the area of the handwriting button 51 has been tapped (No in Step S13), the operation goes on to Step S22.

The control section 11 calls a handwriting routine and processes handwriting input.

S21 is a step of updating the display of the handwriting button 51.

The control section 11 calls a handwriting button display updating routine and updates the display of the handwriting button 51.

S14 is a step of determining if the area of the handwriting button 51 has been tapped or not.

The control section 11 determines if the area of the handwriting button 51 of the touch panel 40 has been tapped or not.

If an area other than the area of handwriting button 51 has been tapped (No in Step S14), the operation goes back to the original routine.

If the area of the handwriting button 51 has been tapped (Yes in Step S14), the operation goes to Step S15.

S15 is a step of enabling the acceptance of handwriting input.

The control section 11 enables the acceptance of a handwriting input from the touch panel 40.

S21 is a step of updating the display of the handwriting button 51.

The control section 11 calls a handwriting button display updating routine to update the display of the handwriting button 51.

Referring to FIGS. 9, 10*a*, 10*b*, and 10*c*, the following describes the handwriting button display updating routine of the present invention.

Figure 9:
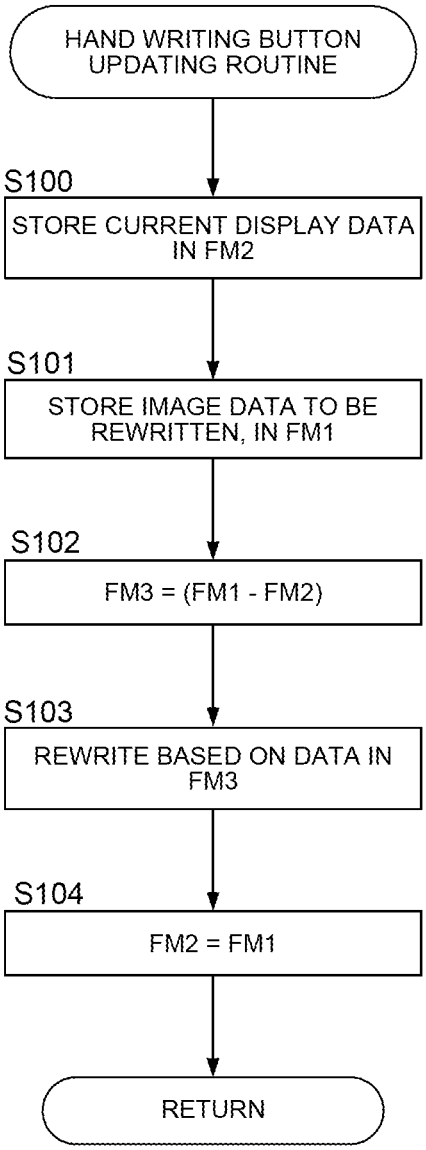
FIG. 9 is a flowchart representing a routine for updating the display of a handwriting button 51 in the embodiment according to the present invention.

FIG. 9 is a flowchart representing the routine for updating the display of the handwriting button 51 in the embodiment according to the present invention. FIGS. 10*a*, 10*b*, and 10*c* is schematic diagrams representing the image data showing the handwriting button 51.

The cells defined by the dotted lines in FIGS. 10*a*, 10*b*, and 10*c* each indicate the pixels of the display screen 50. The numeral in each box indicates the image data stored in each of frame memories corresponding to the pixel. In the present embodiment, the numerals 0 through 10 of the image data correspond to densities d0 through d10, respectively. The inside of the range indicated by the solid lines in FIGS. 10*a*, 10*b*, and 10*c* indicate the pixels showing the shape of the handwriting button 51. Further, FIG. 10*a* shows the data in the 2nd flame memory 61, FIG. 10*b* shows the data in the 1st frame memory 60, and FIG. 10*c* shows the data in the 3rd frame memory 62.

The pixel data showing the shape of the handwriting button 51 in FIG. 10*a* are 6 or 4, and represent the density of d6 or d4. In the example of the display element 1 explained with reference to FIG. 6, the d6 is red, and the d6 is shown in the red with lower density. The image data other than the pixel showing the shape of the handwriting button 51 is 0, and the density is d0, and accordingly white is displayed.

The pixel data showing the shape of the handwriting button 51 in FIG. 10*b* represent 10 or 8, and represent the density of d10 or d8. In the example of the display element 1 explained with reference to FIG. 6, the d10 is black, and the d8 is shown in the gray which is lighter than the d10. The image data other than the pixel showing the shape of the handwriting button 51 is 0, and the density is d0, and accordingly white is displayed.

The pixel data showing the shape of the handwriting button 51 in FIG. 10*e* is the difference data of the pixels corresponding to the 2nd frame memory 61 and 1st frame memory 60 calculated by the difference calculation section 71. In this example, the difference data of other than the pixels showing the shape of the handwriting button 51 is 0.

In the present embodiment, the following describes an example of rewriting from the state where the handwriting button 51 is displayed in red, to the state where the handwriting button 51 is displayed in black.

The following description is based on the order given in the flowchart of FIG. 9:

S100 is a step of storing the image data displayed on the display screen 50, into the 2nd frame memory 61.

The control section 11 causes the 2nd frame memory 61 to store the image data being displayed on the display screen as shown in FIG. 10*a*, for example.

S101 is a step of storing the image data with which the display on the display screen 50 is rewritten, into the 1st frame memory 60.

The control section 11 causes the 2nd frame memory 61 to store the image data in the area of the shape of the handwriting button 51 into, as shown in FIG. 10*b*, for example.

S102 is a step of storing the difference data of the corresponding pixels of the 2nd frame memory 61 and the 1st frame memory 60, into the 3rd frame memory 62.

The difference calculation section 71 calculates the difference data between the corresponding pixels of the 2nd frame memory 61 and the 1st frame memory 60, and stores the result into the 3rd frame memory 62 as shown in FIG. 10*c*, for example.

S103 is a step of rewriting the display elements 1 according to the data of the 3rd frame memory 62.

The control section 11 rewrites the display elements 1 according to the data of the 3rd frame memory 62. If the difference data of the pixel in the area of the shape of the handwriting button 51 is 4, the writing operation is performed four times into the corresponding pixel in the procedure described in reference to FIG. 4. Then the density of the written pixel will be d10 or d8, and the handwriting button 51 will appear black.

S104 is a step of storing the image data of the 1st frame memory 60 into the 2nd frame memory 61.

The control section 11 stores the image data in the 1st frame memory 60 into the 2nd frame memory 61.

As described above, in the present invention, the difference data is calculated, and the rewriting is performed based on the difference data. Accordingly, a desired portion is rewritten in one rewriting operation. This arrangement reduces the rewriting and display time as compared to the conventional method where rewriting operation is performed after the entire screen has been initialized.

The handwriting button display updating routine has been described above.

Figure 11:
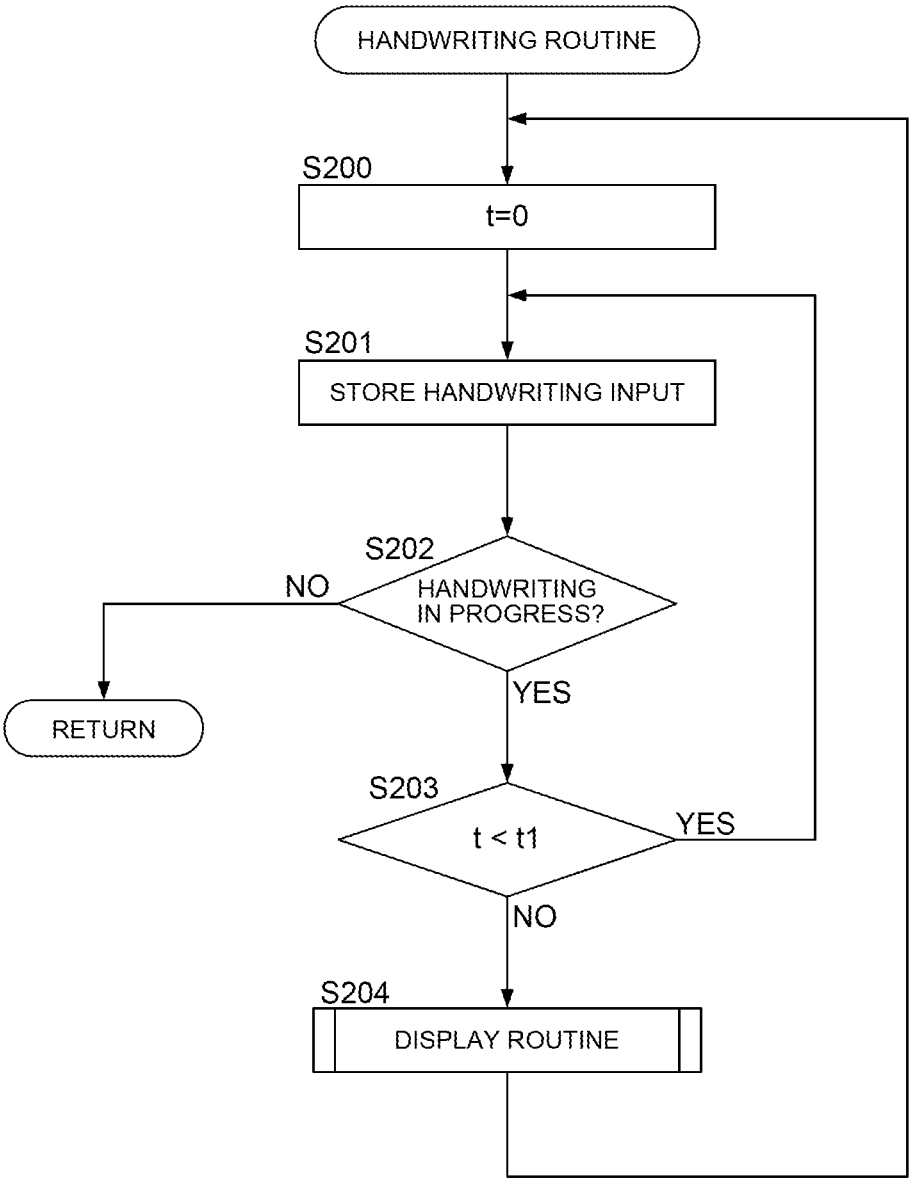
FIG. 11 is a flowchart representing a handwriting routine for processing the handwriting input in the embodiment according to the present invention.
Figure 12:
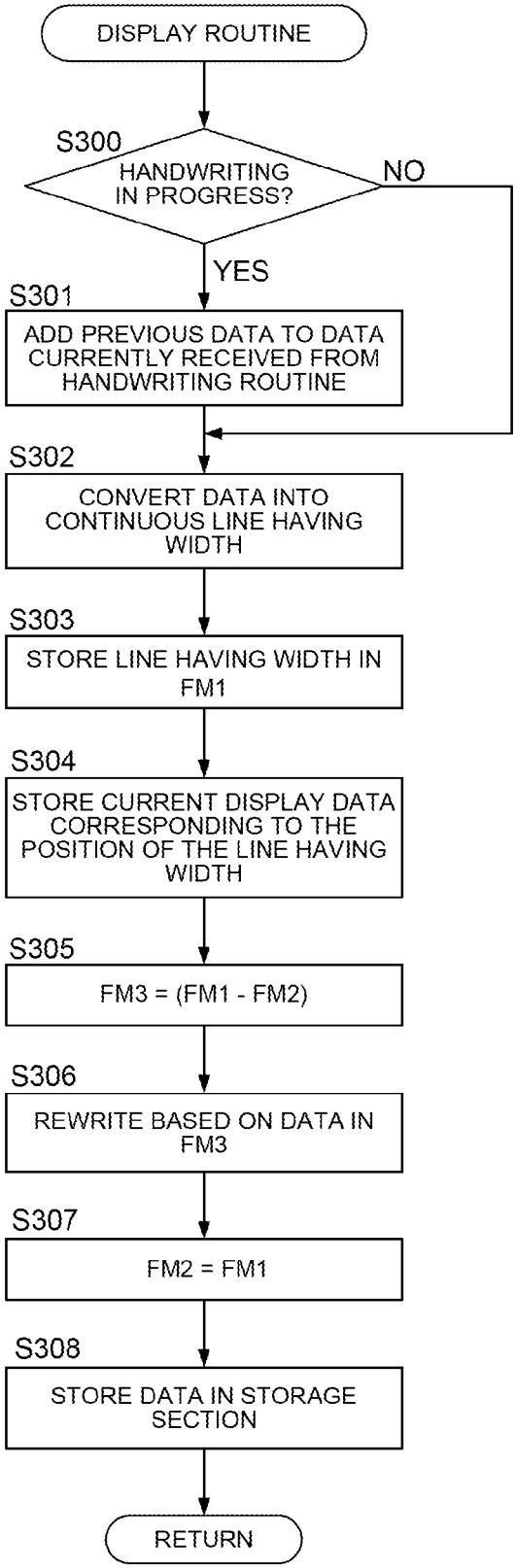
FIG. 12 is a flowchart representing a display routine for displaying the handwriting input in the embodiment according to the present invention.

The following describes the handwriting routine of the present invention with reference to FIGS. 11, 12 and 13:

FIG. 11 is a flowchart representing the handwriting routine for processing the handwriting input in an embodiment of the present invention. FIG. 12 is a flowchart representing the display routine for displaying the handwriting input in the embodiment according to the present invention. FIGS. 13*a* to 13*e* are schematic diagrams representing the handwriting input image displayed on the display screen 50 and the image data of the corresponding pixels.

In the first place, the handwriting routine of FIG. 11 will be described. In the present embodiment, the positional information of the position, on the touch panel 40, touched in succession is collected for a predetermined period of time. Based on the collected position information, the display routine displays on the display screen 50. The following describes the flow chart of FIG. 11.

S200 is a step of resetting the timer.

The control section 11 resets the internal timer as t=0.

S201 is a step of storing the handwriting input.

The control section 11 temporarily stores the positional information sent from the touch panel controller 41, into the storage section 10.

S202 is a step of determining whether or not handwriting input is being performed on a continuous basis.

The control section 11 determines whether or not handwriting input is being performed on a continuous basis.

If the handwriting is not being performed on a continuous basis (No in Step S202), processing is terminated, and the operation returns to the original routine.

If the handwriting is not being performed on a continuous basis (Yes in Step S202), the operation goes on to Step. S203.

S203 is a step of determining if t<t1 or not.

The control section 11 determines whether or not the elapsed time on the timer is below a predetermined elapsed time t1.

If t<t1 is not met (No in Step S202), the operation goes to Step S204.

The control section 11 determines that a predetermined time has elapsed, and the operation goes on to Step S204.

S203 is a step of causing the display routine to perform a process.

The control section 11 calls the display routine and delivers the handwriting input data. The display routine processing will be described later.

When t<t1 (Yes in Step S202), the operation goes back to Step S201.

The handwriting routine has been described above.

The following describes the schematic diagram of FIGS. 13*a* to 13*e* before describing the display routine.

The cells defined by the dotted line in FIGS. 13*a* to 13*e* represent the pixels of the display screen 50. FIG. 13*a* is an enlarged view representing a part of the character displayed on the display screen 50 of FIG. 7*a*. FIG. 13*b* is an enlarged view representing a part of the character and the underline 56 displayed on the display screen 50 of FIG. 7*b*. The numerals in the cells of the FIGS. 13*c*, 13*d* and 13*e* indicate the image data stored in each of frame memories corresponding to the relevant pixels. Similarly to the case of FIG. 10, the numerals 0 through 10 of the image data correspond to densities d0 through d10. The inside of the range indicated by the solid lines in FIGS. 13*d* and 13*e* indicates the pixel showing the underline 56.

FIG. 13*c* shows the data of the 2nd frame memory 61, FIG. 13*d* shows the data of the 1st frame memory 60, and FIG. 13*e* shows the data of the 3rd frame memory 62.

The image data showing the character "October (in Japanese characters)" in FIG. 13*c* indicates 10 denoting the density of d10. In the example of the display element 1 described in reference to FIG. 6, the density is d10 giving a black display. The image data other than the pixels representing the character is 0 denoting the density of d0, and white is displayed.

The image data representing the underline 56 in FIG. 13*d* is 6 denoting the density of d6. In the example of the display element 1 described in reference to FIG. 6, the density is d6 is displayed in red.

The image data representing the underline 56 in FIG. 13*e* is the difference data of the corresponding images of the 2nd frame memory 61 and the 1st frame memory 60. In this example, the pixel data in the area of the shape of the underline 56 is 6, and the pixel data, in the 2nd frame memory 61, corresponding to that area is 0 or 10. Thus, as shown in FIG. 13*e*, the difference data is 6 or −4. Further, the difference data other than the pixels representing the underline 56 is 0.

In the present embodiment, the following describes an example of rewriting in such a way that the red underline 56 will be displayed as shown in FIG. 13.

The following description is based on the order given in the flow chart of FIG. 12.

S300 is a step of determining whether or not handwriting input is being performed on a continuous basis.

The control section 11 determines whether or not handwriting input is being performed on a continuous basis.

If the handwriting input is not being performed on a continuous basis (No in Step S300), the operation goes to Step S302.

If the handwriting input is being performed on a continuous basis (Yes in Step S300), the operation goes on to Step S301.

S301 is a step of adding the previous data to the data received from the handwriting routine.

The control section 11 adds the previous data to the data received from the handwriting routine.

S302 is a step of converting the data into the continuous line data having a width.

The control section 11 converts the data into the continuous line data having a width.

S303 is a step of storing the continuous line data having a width into the 1st frame memory 60.

The control section 11 stores the continuous line data having a width in the 1st frame memory 60, as shown in FIG. 13*d*.

S304 is a step of storing the currently displayed display data at the position corresponding to the line data, into the 2nd frame memory 61.

The control section 11 stores the currently displayed display data corresponding to the line data stored in the 1st frame memory 60, into the 2nd frame memory 61, as shown in FIG. 13*c*.

S305 is a step of storing the difference between the data in the 2nd frame memory 61 and the corresponding data in the 1st frame memory 60, into the 3rd frame memory 62.

The difference calculation section 71 calculates the difference data between the data in the 2nd frame memory 61 and the corresponding data in theist frame memory 60, and stores the result into the 3rd frame memory 62, for example, as shown in FIG. 13*e*.

S306 is a step of rewriting the display element 1 based on the data in the 3rd frame memory 62.

The control section 11 rewrites the display elements 1 based on the data in the 3rd frame memory 62. When the difference data of the pixel on the part of the underline 56 is 6, the control section 11 sets the Vs to be a negative voltage, and sets the Vc to be a negative voltage during the writing time T2. Writing operation is performed six times to the corresponding pixel according to the procedure described in reference to FIG. 4. Then the density of the written pixel will be d6 and is displayed in red. When the difference data is −4, the control section 11 sets the Vs to be a positive voltage, and sets the Vc to be a positive voltage during the writing time T2. Writing operation is performed four times to the corresponding pixel according to the procedure described with reference to FIG. 4. Then the density of the written pixel will be d6 and is displayed in red.

As described above, in the present invention, the difference data is calculated and rewriting operation is performed based on the calculated difference data. Accordingly, a desired portion is rewritten in one rewriting operation. This arrangement reduces the rewriting time as compared to the conventional method where rewriting operation is performed after the entire screen has been initialized.

S307 is a step of storing the image data of the 1st frame memory 60 in the 2nd frame memory 61.

The control section 11 stores the image data of the 1st frame memory 60 in the 2nd frame memory 61.

S308 is a step of storing the data in the storage section 10.

The control section 11 stores the currently written data in the storage section 10.

The display routine has been described above.

The page feed routine will be described lastly. In the page feed routine, when the image of a new page is to be displayed on the display screen 50, the entire display element 1 is initialized. Then the image data is rewritten and displayed.

Figure 14:
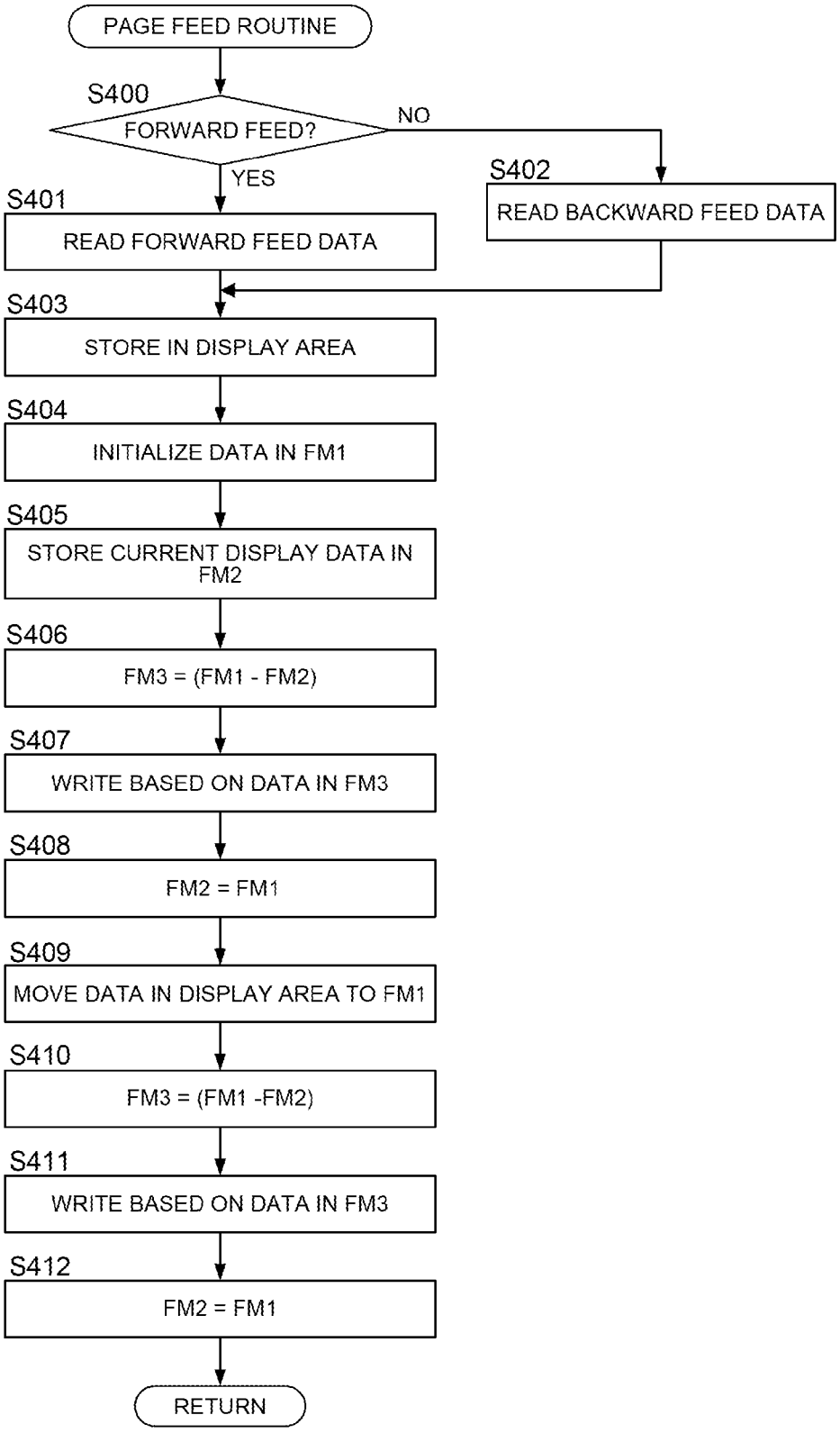
FIG. 14 is a flowchart representing a page feed routine in the embodiment according to the present invention.

FIG. 14 is a flowchart representing the page feed routine in the embodiment of the present invention. The following description is based on the order of the flow chart of FIG. 14.

S400 is a step of determining if the page feed is forward feed or not.

The control section 11 detects which of the forward feed button 43 or backward feed button 44 is turned on, and determines if the page feed is forward feed or not.

If the page feed is not forward (No in Step S400), the operation goes on to Step S402.

If the page feed is forward (Yes in Step S400), the operation goes on to Step S401.

S401 is a step of reading the forward feed data.

The control section 11 reads from the storage section 10 the data on the screen to be displayed next in the forward feed.

S402 is a step of reading the backward feed data.

The control section 11 reads the data to be displayed on the screen next by the backward feed, from the storage section 10.

S403 is a step of storing the screen data in the display area

The control section 11 stores the screen data read out from the storage section 10, in the display area in the RAM of the storage section 10.

S404 is a step of initializing the data of the 1st frame memory 60.

The control section 11 initializes the entire data of the 1st frame memory 60 to 0. It should be noted that in this initialization process causes of the variation in the memory characteristics need to be reset. For example, in the case of SECD display element, variation occurs in the amount of silver segregation due to temperature or other factors. At the time of initialization, components for cancelling the variation must be included. For example, when the amount of the variation is assumed to be in the range of ±2, the data value for initializing the 1st frame memory 60 must be set at −2 instead of 0, for all the data S405 is a step of storing the currently displayed data in the 2nd frame memory 61.

The control section 11 stores the currently displayed data in the 2nd frame memory 61.

S406 is a step of storing the difference data between the pixels of the 2nd frame memory 61 and the corresponding pixels of the 1st frame memory 60, in the 3rd frame memory 62.

The control section 11 calculates the difference data between the data in the 2nd frame memory 61 and the corresponding data in the 1st frame memory 60, and stores the result in the 3rd frame memory 62.

S407 is a step of rewriting the display elements 1 based on the data in the 3rd frame memory 62.

The difference calculation section 71 rewrites the display elements 1 based on the data in the 3rd frame memory 62. Since all the data in the 1st frame memory 60 is 0, the difference data includes 0 and negative. When the variations of the display elements are taken into account, the amounts of the variations must be added, as in the case of step S404. Therefor; the control section 11 sets Vs to be a positive voltage, and sets the Vc to be a positive voltage during the writing time T2. The writing operation is performed on the corresponding pixels the number of times based on the difference data, according to the procedure described with reference to FIG. 4. This procedure changes the density of the written pixels to d0, and the pixels are displayed in white.

The aforementioned operation allows all the display elements to be displayed in white. This can be considered that they are in so called reset state. After that, it is possible to show a desired level of gradation by rewriting the display element using the data to be displayed.

S408 is a step of storing the screen data stored in the 1st frame memory 60, in the 2nd frame memory 61.

The control section 11 stores the screen data stored in the 1st frame memory 60, in the 2nd frame memory 61, and initializes the 2nd frame memory 61 by setting the all data to be 0.

S409 is a step of storing the screen data stored in the display area, in the 1st frame memory 60.

The control section 11 stores in the 1st frame memory 60 the screen data stored in the display area to be displayed next.

S410 is a step of storing the difference data between the pixels of the 2nd frame memory 61 and the corresponding pixels of the 1st frame memory 60, in the 3rd frame memory 62.

The difference calculation section 71 calculates the difference data between the pixels of the 2nd frame memory 61 and the corresponding pixels of the 1st frame memory 60, and stores the result in the 3rd frame memory 62.

S411 is a step of rewriting the display elements 1 based on the data in the 3rd frame memory 62.

The control section 11 rewrites the display elements 1 based on the data in the 3rd frame memory 62. This data is a positive value. Thus, the control section 11 sets Vs to be a negative voltage, and sets the Vc to be a negative voltage during the writing time T2. The writing operation is performed the number of times corresponding to the data according to the procedure describable in FIG. 4.

As described above, the entire screen is initialized according to the same procedures as those for the handwriting button display updating routine and the handwriting routine, using the 1st frame memory 60, the 2nd frame memory 61 and the 3rd frame memory 62. After that, the writing operation is performed. This ensures accurate reproduction and display of the gradation.

S412 is a step of storing the image data in the 3rd frame memory 60, in the 2nd frame memory 61.

The control section 11 stores the image data in the 1st frame memory 60, in the 2nd frame memory 61.

The page feed routine has been described above.

As described above, the present invention provides a reflection type display device characterized by display with quick response.

The invention claimed is:

1. A display device, comprising:

an electrochemical display device having a display screen including display elements arranged in a matrix, and being configured to display an image by each of the display elements being supplied with a writing current for a writing time, the writing current or the writing time being varied depending on a density of the image to be displayed, a predetermined amount of electric charge being accumulated in each of the display elements, each of the display elements showing a display density depending on the predetermined amount of electric charge, and each of the display elements retaining the display density until the predetermined amount of electric charge changes;

a first storage section configured to store, as first image data, densities of a first image which is going to be displayed on the display screen by the display elements;

a second storage section configured to store, as second image data, densities of a second image displayed on the display screen by the display elements;

a difference calculation section configured to calculate difference data representing difference in image densities for the respective display elements between the second image data and the first image data;

a third storage section configured to store the difference data calculated by the difference data calculation section;

a constant current circuit configured to supply the writing current depending on an applied control voltage;

a switching element configured to control applying and cutting of the control voltage;

a driver circuit configured to apply the control voltage to the constant current circuit through the switching element;

a control voltage power source configured to supply the control voltage to the driver circuit;

a common power source configured to apply a common voltage to the display elements, the common voltage being set so as to determine a supply direction of the writing current so that the display density of each of the display elements is increased or decreased; and a control section configured to control, based on the difference data stored in the third storage section, the writing current or the writing time, and the common voltage to change the electric charge accumulated in each of the display elements, each of the display elements showing the display density depending on the changed electric charge accumulated therein;

wherein each of the display elements is written with the density thereof being increased or decreased depending on the common voltage.

2. The display device of claim 1, wherein a first terminal of the constant current circuit is connected to a first voltage, a second terminal of the constant current circuit is connected to a first terminal of each of the display elements, a second terminal of each of the display elements is connected to the common voltage, the writing current thus flows between the first voltage and the common voltage through the constant current circuit and each of the display elements, and the supply direction of the writing current depends on whether the common voltage is higher or lower than the first voltage.

* * * * *